US006404998B1

(12) United States Patent
Tanaka et al.

(10) Patent No.: US 6,404,998 B1
(45) Date of Patent: Jun. 11, 2002

(54) IMAGE FORMING APPARATUS DETERMINING TRANSFER VOLTAGE BASED ON TRANSFERRING MEMBER RESISTANCE VALUE AND TRANSFERRING MATERIAL RESISTANCE VALUE

(75) Inventors: Yuko Tanaka, Yokohama; Masahiro Goto, Mishima; Satoru Izawa, Shizuoka-ken; Norihito Naito, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/675,015

(22) Filed: Sep. 29, 2000

(30) Foreign Application Priority Data

Oct. 6, 1999 (JP) ..... 11-285317

(51) Int. Cl.[7] ..... G03G 15/00; G03G 15/16
(52) U.S. Cl. ..... 399/66; 399/314
(58) Field of Search ..... 399/66, 45, 314; 430/126

(56) References Cited

U.S. PATENT DOCUMENTS 5,198,863 A 3/1993 Goto et al. ..... 399/314
5,953,556 A * 9/1999 Yamanaka ..... 399/66
5,999,760 A * 12/1999 Suzuki et al. ..... 399/45
6,035,151 A * 3/2000 Ono et al. ..... 399/66 X
6,058,275 A * 5/2000 Kodama ..... 399/66 X

FOREIGN PATENT DOCUMENTS

JP 05-323805 * 12/1993

* cited by examiner

*Primary Examiner*—Sophia S. Chen
(74) *Attorney, Agent, or Firm*—Fitzpatrick, Cella, Harper & Scinto

(57) ABSTRACT

The present invention provides an image forming apparatus which has an image bearing body for bearing a toner image, a transferring member for forming a nip with the image bearing body to pinch a transferring material and for transferring the toner image on the image bearing body to the transferring material, voltage applying device for applying a transfer voltage to the transferring member, voltage detecting device for detecting an applied voltage at which a predetermined current flows through the transferring member before a transferring operation, current detecting device for detecting a current flowing when a voltage based on a detected voltage of the voltage detecting device is applied to the transferring member in a condition where a tip end of the transferring material is present at the nip, and voltage determining device for determining the transfer voltage after the tip end of the transferring material, based on a detected current by the current detecting device.

6 Claims, 7 Drawing Sheets

L/L ENVIRONMENT

N/N ENVIRONMENT

H/H ENVIRONMENT

IMAGE FORMING APPARATUS DETERMINING TRANSFER VOLTAGE BASED ON TRANSFERRING MEMBER RESISTANCE VALUE AND TRANSFERRING MATERIAL RESISTANCE VALUE

BACKGROUND OF THE INVENTION

1. Field of the Invention

The present invention relates to an image forming apparatus using an electrophotography method or an electrostatic method, such as a copying machine or a printer, and more particularly to an image forming apparatus using a contact transferring method.

2. Related Background Art

Image forming apparatuses of a transfer type mainly use contact transferring means, especially such means of a roller transfer type to transfer a toner image formed and borne on an image bearing body onto transferring material. This is partly because, as contrasted with transferring means using a non-contact type corona charger, contact transferring means does not produce ozone. Contact transferring means has a transferring member which forms the image bearing body and a pressing nip transfers a toner image onto transferring material inserted into the pressing nip. Contact transferring means of a roller transfer type uses a roller (transferring roller) as a contact transferring member. Contact transferring means has advantages of stable transferring material conveyance etc.

Contact transferring means of a roller transfer type uses as a contact transferring member a transferring roller (electrically conductive elastic roller) with an intermediate-resistance elastic layer whose resistance is adjusted to $1\times10^{6}$ to $1\times10^{10}$ Ω. The roller is brought into contact with an image bearing body (hereinafter called a photosensitive drum) to form a pressing nip, or a transferring nip, between the photosensitive drum and transferring roller. By applying a transferring bias to the transferring roller while transferring material is conveyed, being nipped at the transferring nip, contact transferring means gives transferring material a charge opposite in polarity to a toner image to transfer the toner image from the photosensitive drum onto the transferring material.

The transferring roller has an elastic layer whose resistance is adjusted as appropriate, using rubber or sponge in which electrically conductive inorganic particles are dispersed, such as carbon particles are dispersed, or electrically conductive ion rubber into which surfactant or the like is kneaded. As is well known, the resistance of the transferring roller changes by one order or more of magnitude due to variations during production, changes in temperature and humidity, and prolonged periods of use.

To keep running an appropriate current through a transferring roller with such changing resistance, a transfer voltage can be applied to the transferring roller by a "constant-current applying method." In this case, however, transferring material is usually used whose width is smaller than the maximum width of paper which can pass through the apparatus. Thus when an area occurs which no paper passes, with the photosensitive drum and transferring roller in direct contact with each other in the direction of the length of the transferring nip, current concentrates on the area, so that current feed to the transferring material is insufficient, causing a poor transfer.

To run an appropriate current through the transferring roller irrespective of transferring material size, many image forming apparatuses use a "constant-voltage applying method." To run an appropriate current according to transferring roller resistance, varying with production conditions and the environment, the constant-voltage applying method exercises active transfer voltage control (ATVC) or programmable transfer voltage control (PTVC). Under ATVC method, a voltage which is produced when a constant current passed through the transferring roller during paper feed is applied to the roller before transfer is kept and applied during transfer. Under PTVC method, on the other hand, a voltage calculated by substituting into a predetermined control equation a voltage which is produced when a constant current is passed through the transferring roller before paper feed is applied during transfer. The constant-voltage applying method detects the impedance of a transferring system by ATVC method, PTVC method, or the like to apply a transfer voltage that allows a current within an appropriate range to run.

A bias can more accurately be controlled by PTVC method than by ATVC method, whose system, consisting of hardware configuration circuits, can provide only a few values of bias to be applied. Moreover, PTVC method is economically advantageous because it needs no hardware circuits for voltage control.

PTVC method will be described in more detail below. When no paper is fed before printing, the level of a pulse width modulation (PWM) signal is increased stepwise toward a target current value, with the photosensitive drum surface charged, to apply a voltage to the transferring roller. A voltage at which the target current value is reached is held as Vt0. A transfer voltage Vt during printing, suitable for Vt0 is determined from Vt0 and a transfer output table stored in advance in a control circuit CPU. A PWM signal corresponding to the transfer voltage Vt is output to apply the voltage Vt to the transferring roller during printing.

Determining the transfer voltage Vt during printing with reference to the voltage Vt0 produced by the transferring roller at a constant current allows the best voltage to be applied during printing according to the resistance of the transferring roller, thus providing a good image, using transferring rollers widely ranging in resistance.

However, the conventional transfer voltage control methods pose the following problems.

Conventional transferring voltage control methods, such as ATVC and PTVC, determine transfer voltage to be applied during transferring from a voltage which is produced when a constant current is passed through the transferring roller, with no transferring material at a transferring nip. In this way, the methods are adapted so that if transferring roller resistance changes, a suitable transferring bias can be applied accordingly by detecting the impedance of the entire transferring system when no paper is fed.

However, if transferring material resistance is too high or low, that is, transferring material whose resistance differs widely from an estimated value is used, a transfer current to be run during printing may be outside the suitable transfer current range.

If transferring material impedance significantly changes, transfer current may be excessive or insufficient, thus resulting in a poor image. Because more image forming apparatuses have recently been used worldwide, types of transferring material used for printing are increasing. With this trend, transferring material with a variety of resistances are used, so that it is difficult to form good images irrespective of the environment and types of transferring material.

It is possible to have a user specify the type of transferring material in a special paper mode to optimize transfer voltage control. However, doing so is not preferable because specifying the type troubles the user.

Japanese Patent Application Laid-Open No. 4-251276 proposes that faulty transfer due to a change in transferring material resistance is prevented by determining transfer voltage from a current which runs when a voltage is applied to the transferring roller at the tip end of transferring material.

However, because this method incorporates the resistance of a combination of the transferring roller and transferring material, it cannot cover a change in either transferring roller resistance or transferring material resistance to be exact.

SUMMARY OF THE INVENTION

It is an object of the present invention to provide an image forming apparatus which does not cause a poor transfer in spite of environmental variations.

It is another object of the present invention to provide an image forming apparatus which can correctly transfer an image irrespective of the type of transferring material.

It is still another object of the present invention to provide an image forming apparatus which can cover an independent change in either transferring member resistance or transferring material resistance.

It is a further object of the present invention to provide an image forming apparatus comprising:

an image bearing body for bearing a toner image;

a transferring member for forming a nip with said image bearing body to pinch a transferring material and for transferring the toner image on said image bearing body to the transferring material;

voltage applying means for applying a transfer voltage to said transferring member;

voltage detecting means for detecting an applied voltage at which a predetermined current flows through said transferring member before a transferring operation;

current detecting means for detecting a current flowing when a voltage based on a detected voltage of said voltage detecting means is applied to said transferring member in a condition where a tip end of the transferring material is present at the nip; and voltage determining means for determining the transfer voltage after the tip end of the transferring material, based on a detected current of said current detecting means.

Other objects of the present invention will be apparent from the following descriptions.

DESCRIPTION OF THE PREFERRED EMBODIMENTS

Figure 1:
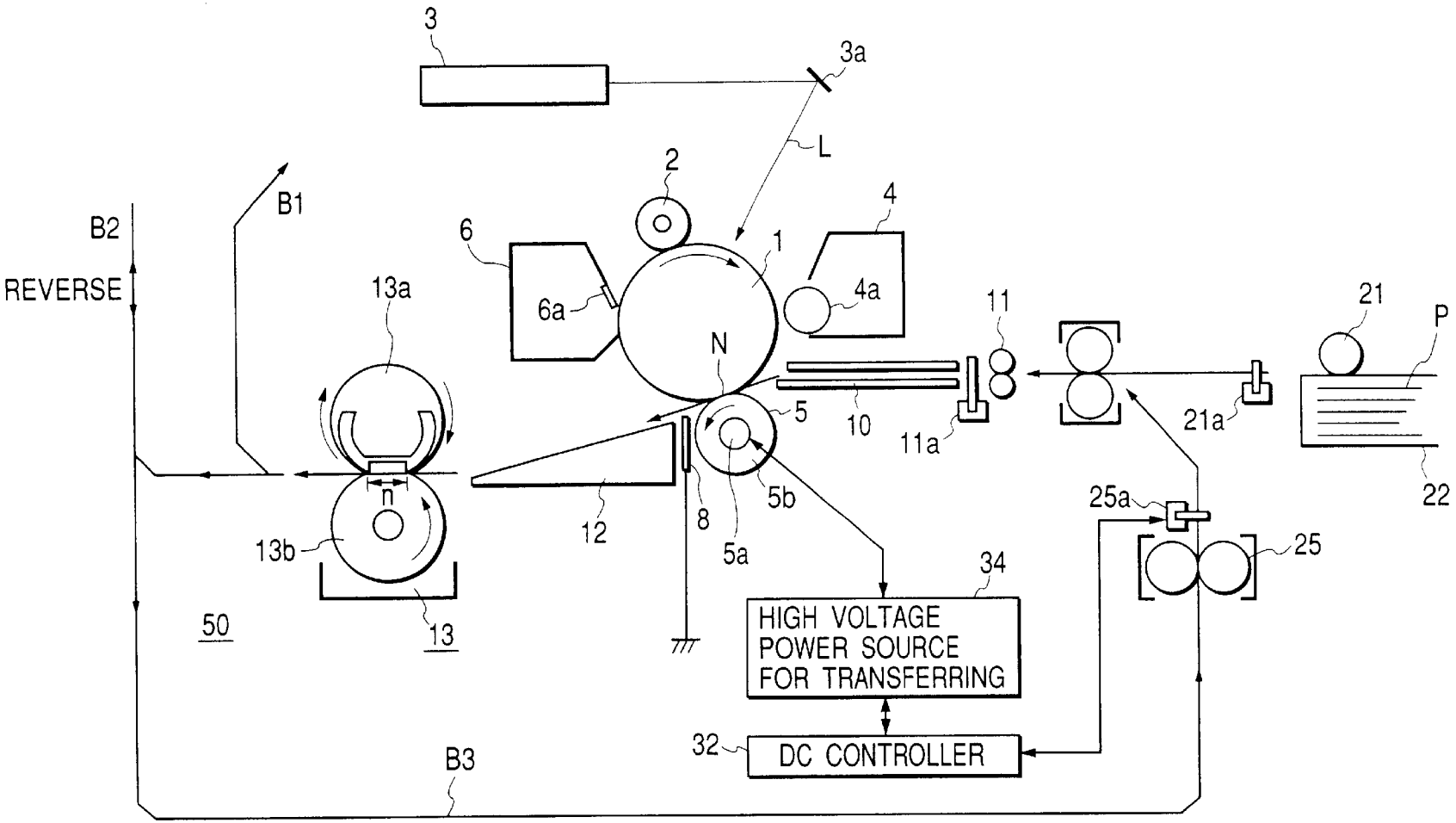
FIG. 1 is a schematic view of an image forming apparatus according to a first embodiment.

Referring now to the drawings, the embodiments of the present invention will be described below. FIGS. 1 through 6 show the first embodiment of the present invention.

FIG. 1 is a schematic view of an example of an image forming apparatus. The image forming apparatus is a laser printer using a transfer type electrophotography process which has a both-side printing function.

Reference numeral 1 denotes a photosensitive drum as an image bearing body which is constituted by providing a photosensitive material, such as OPC or amorphous SI, on a cylindrical substrate, made of aluminum, nickel, or the like, is turned clockwise as indicated by an arrow by driving means, not shown, at a predetermined circumferential speed.

Reference numeral 2 denotes charging means for uniformly charging the outer surface of photosensitive drum 1 so that a predetermined polarity and potential are provided. For the embodiment, the means is a contact charging apparatus using a charging roller.

Reference numeral 3 denotes a laser beam scanner as image information exposing means. The scanner 3 includes a semiconductor laser, a polygon mirror, and an Fθ lens. By emitting a laser beam L, undergoing ON/OFF control according to a time series electrical digital pixel signal fed from a host apparatus, not shown, the scanner scans and exposes the uniformly charged surface of the photosensitive drum 1 through a reflecting mirror 3*a* to form an electrostatic latent image.

Reference numeral 4 denotes a developing apparatus, which develops the electrostatic latent image on the photosensitive drum 1 as a toner image. Reference symbol 4*a* denotes a developing roller or a developing sleeve. The developing apparatus uses a jumping method or a two-component developing method in combination with image exposure and reversal developing.

Reference numeral 5 denotes a transferring roller as a contact transferring member which is a body of revolution with an elastic layer. A transferring nip N is formed by pressing the roller against the photosensitive drum 1. By driving means, not shown, the transferring roller is turned counterclockwise like the photosensitive drum 1 as indicated by an arrow at a predetermined circumferential speed substantially corresponding to the circumferential speed of the photosensitive drum 1.

Reference numeral 22 denotes a sheet feeding cassette, into which transferring material P is stacked. The transferring material P in the sheet feeding cassette 22 is fed sheet by sheet by a feeding roller 21, made to wait at a pre-feed sensor 21*a,* and fed through a registration roller 11, a registration sensor 11*a,* and a pre-transfer guide 10 to the transferring nip N (an image forming portion) at a predetermined control timing. That is, the transferring material P is fed to the transferring nip N, being synchronized by the registration sensor 11*a* with toner image formation on the photosensitive drum 1.

After fed to the transferring nip N, the transferring material P is nipped (pinched) between the photosensitive drum 1 and transferring roller 5 and conveyed with rotation of the drum and roller. When the transferring material P is nipped at the transferring nip N and conveyed, a predetermined control transferring bias is applied from a transferring high-voltage power supply (transferring high-voltage transformer) 34 to the transferring roller 5, which is in contact with the back of the transferring material P, at a predetermined control timing. Thus a charge which is opposite in polarity to the toner image is given to the transferring material P, and then the toner image is sequentially transferred from the photosensitive drum 1 onto the transferring material P.

After passing the transferring nip N, the transferring material P, onto which the toner image is transferred at the transferring nip N, is separated from the surface of the photosensitive drum 1 and conveyed through a sheet path (guide member) 12 to a fixing apparatus 13. A reference numeral 8 denotes a discharging needle. The fixing apparatus 13 is of a so-called film heating type, which consists of a heating film unit 13*a* and a pressing roller 13*b* pressed against each other. The transferring material P, which holds the toner image, is nipped at a fixing nip n, or a contact between the heating film unit 13*a* and pressing roller 13*b* pressed against each other, nipped, conveyed, heated, and pressed, so that the toner image is fixed onto the transferring material P, thus providing a permanent image.

In a one-sided printing mode, after leaving the fixing apparatus 13, the transferring material P is guided to a conveying path B1 and ejected as one-sided printed matter from the apparatus.

In a double-sided (both-sided) printing mode (automatic double-sided printing mode), after leaving the fixing apparatus 13, the transferring material P, which is printed on one side, is conveyed to a both sides unit 50, reversed through a switchback conveying path B2, refed through a refeeding roller 25 and a refeeding sensor 25*a* to the transferring nip N to start printing on the other side of the transferring material P.

After a toner image is transferred onto the other side of the transferring material P at the transferring nip N, the transferring material P is separated from the surface of the photosensitive drum 1 and reconveyed through the sheet path 12 to the fixing apparatus 13. Then after the toner image on the other side is fixed, the transferring material is guided to the conveying path B1 and ejected as a double-sided printed matter from the apparatus.

After a toner image is transferred onto the transferring material P, the surface of the photosensitive drum 1 is cleaned of residual toner by a cleaning apparatus 6 to repeatedly use the drum for image formation. The cleaning apparatus 6 in the embodiment is a blade cleaning apparatus. Reference numeral 6*a* denotes a cleaning blade.

(2) Transferring roller 5

The transferring roller 5, used as a contact transferring member, is a rubber roller which is produced by coating a core 5*a*, made of iron, SUS, or the like, with EPDM, silicone rubber, NBR, urethane rubber, etc. to provide an elastic medium-resistance layer 5*b* looking like a solid (filled) or expanded sponge. The roller has an Asker C hardness of 25 to 70 degree (under a load of 1 kg) and a resistance of $10^6$ to $10^{10}$ Ω. After undergoing primary and secondary vulcanization, the elastic layer 5*b* of the transferring roller 5 is ground until a desired outer diameter is obtained.

The transferring roller 5, used for the embodiment, is an electrically conductive, elastic solid roller with a hardness of 60, an outer diameter of 16 mm, and a rubber part longitudinal dimension of 218 mm, which is produced by forming an elastic layer 5*b* (elastic medium-resistance layer), made of NBR-based electrically conductive ionic solid rubber with a resistance of $8\times10^7$ Ω, on the Fe core 5*a* having a diameter of 6 mm.

Figure 2:
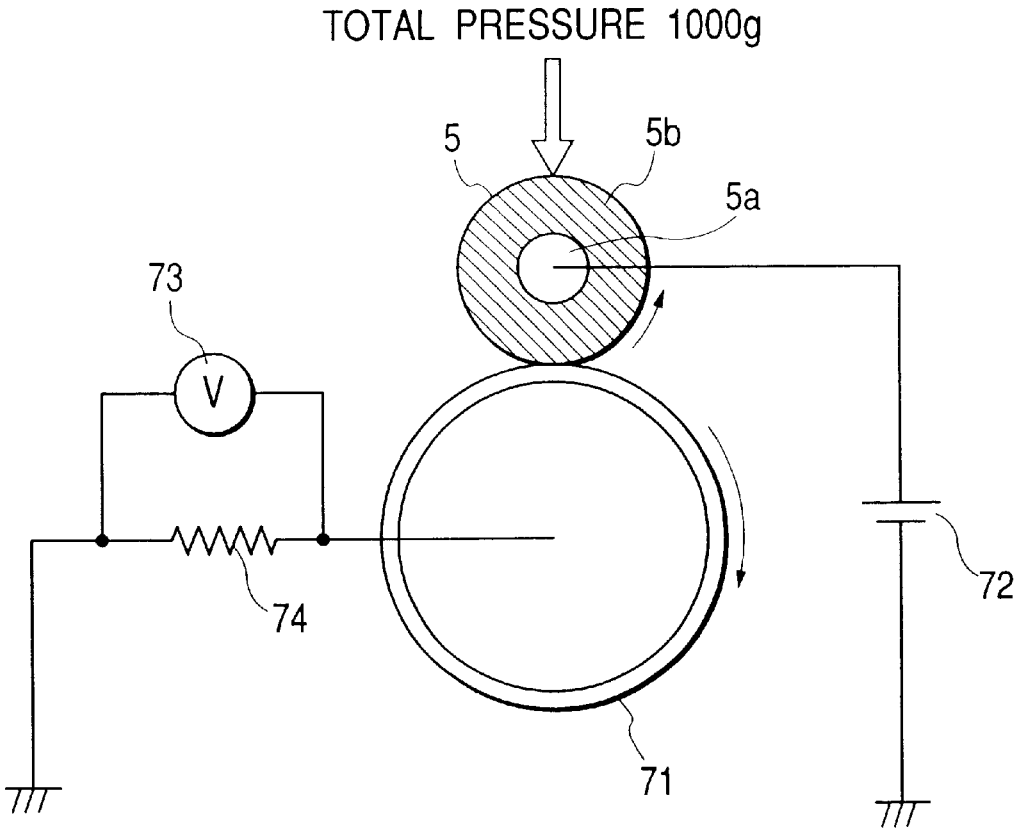
FIG. 2 illustrates a method for measuring transferring roller resistance value.

FIG. 2 illustrates a method for measuring the resistance of the transferring roller 5. That is, the method reads a maximum and a minimum voltage occurring across a resistor 74, using a voltmeter 73 when the transferring roller 5 is rotated, with an aluminum cylinder 71 in contact with the roller under a total pressure of 1000 g (500 g for each side), and a voltage is applied from a DC high-voltage power supply 72 to the core 5*a* of the transferring roller 5. An average of voltage running through the circuit is calculated from the voltage read to obtain the resistance of the transferring roller 5. Measurements are usually made in a normal environment N/N (23° C., 60%).

(3) Transferring bias control

The embodiment exemplifies a system which detects the resistance of the transferring material to correct a transfer voltage determined by PTVC control and adds different correction values to the transfer voltage, depending on the result of detection under PTVC control.

a) PTVC control method

Figure 3:
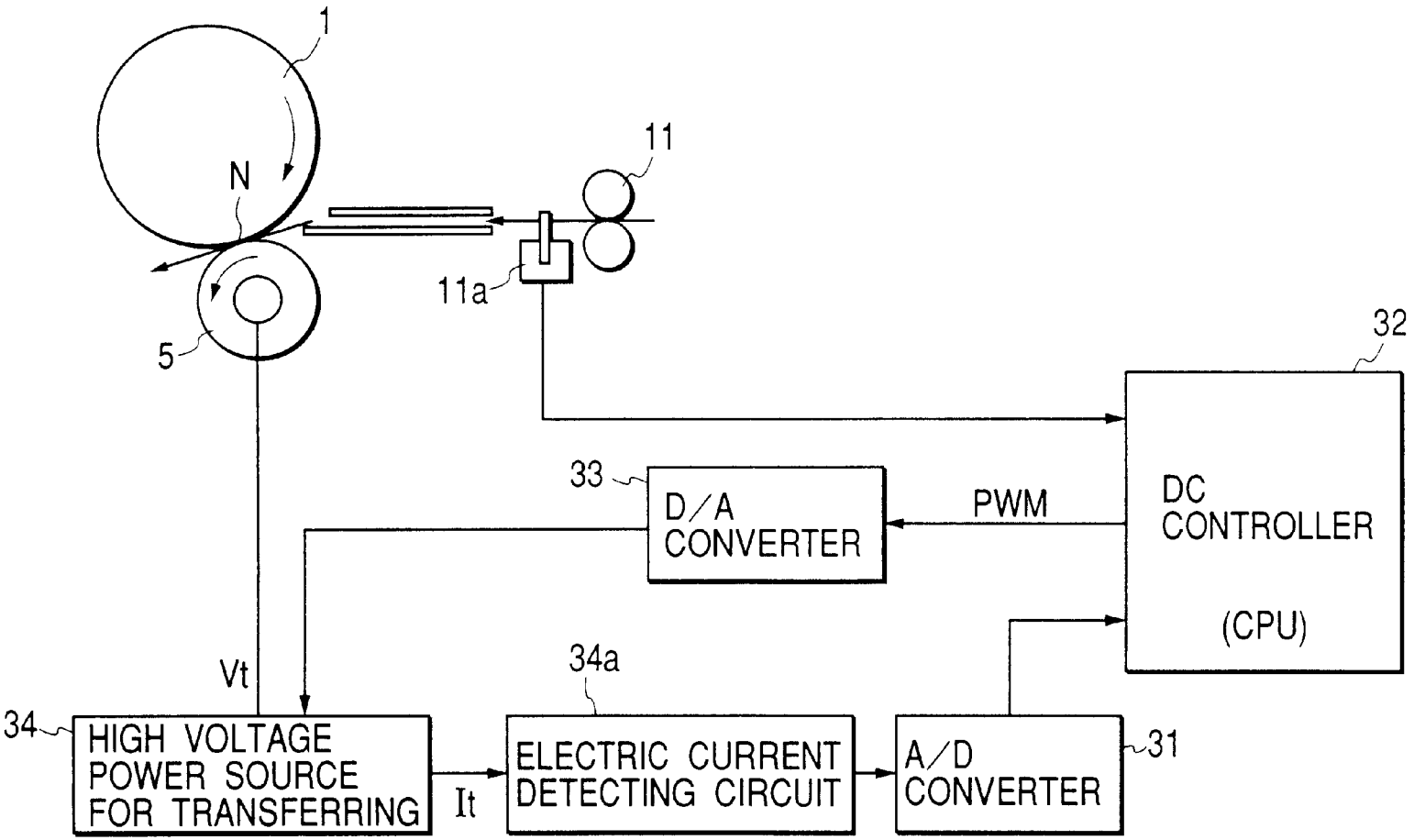
FIG. 3 illustrates PTVC control.

Referring now to FIG. 3, a PTVC control method for the embodiment will be detailed below. A reference numeral 32 denotes a DC controller which controls an image forming apparatus. In the controller, a CPU which controls a transferring bias is installed.

The CPU outputs from an OUT terminal a PWM signal with a pulse width corresponding to a desired transferring output voltage. A transferring output table (not shown) corresponding to the pulse width is stored in the CPU. The PWM signal is fed through a D/A converter 33 to a transferring high-voltage power supply 34, so that a voltage corresponding to the value of the signal is output as a transferring output voltage Vt. A current It running at that time is supplied to an IN terminal of the CPU, and the current is detected in the CPU. For the embodiment, a current running to a transferring high-voltage circuit is detected by a current detecting circuit 34*a*, and a value (AD value), obtained by converting that of the current from analog to digital using an A/D converter 31, is fed to the CPU to determine the value of the current running to the transferring roller 5.

To exercise "constant-voltage control", a pulse width corresponding to a desired voltage is determined from a PWM preset in the CPU and the transferring output table, and a PWM signal with the pulse width is output.

Furthermore, to exercise "constant-current control", the pulse width of a PWM signal from the CPU is gradually increased until the value of a signal entering the IN terminal of the CPU corresponds to a desired current value (constant current value), and then voltage value (pulse width) is changed according to a current change.

b) Transfer control algorithm

Figure 4:
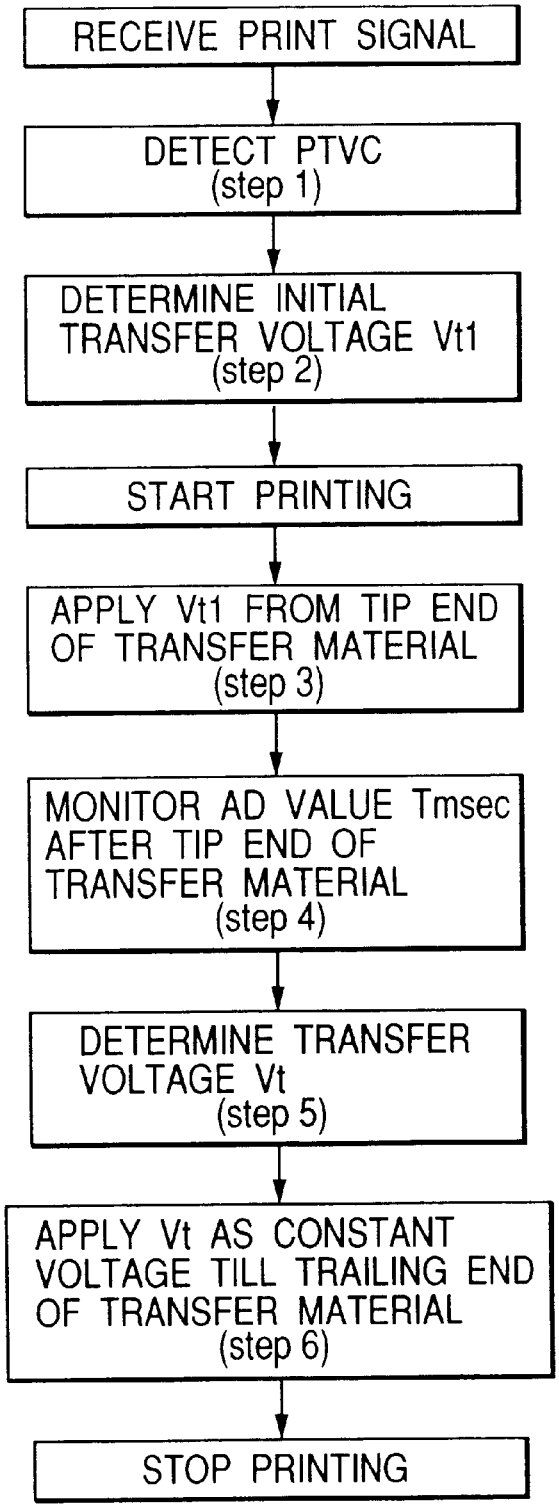
FIG. 4 illustrates a transfer voltage control sequence for the first embodiment.

FIG. 4 shows a transfer control algorithm for the embodiment.

When a print signal is received from a host computer, and charging the photosensitive drum 1 is completed, PTVC detection is performed once, with the photosensitive drum 1 in direct contact with the transferring roller 5 (step 1).

PTVC detection holds a voltage Vt0 at which transfer current reaches a predetermined value when output voltage from the transferring high-voltage power supply 34 gradually increases.

Based on the result of detection, a first target transfer voltage Vt1 to be applied during transfer is determined from the following transfer control equation 1 stored in advance in the CPU (step 2):

$$Vt1=\alpha Vt0+\beta \quad \text{(Equation 1)}$$

where

Vt0 is a voltage produced when a predetermined detection current is applied to the transferring roller during PTVC detection α and β are constants preset according to a transferring system The initial target transfer voltage may be a voltage as produced during PTVC detection. However, for the embodiment, to increase transfer voltage to a value necessary for subsequent steps in a short time, a transfer voltage which allows a good image to be formed on plain paper is applied.

When image formation preparations are completed after Vt1 is determined, printing is started to convey the transferring material P to the transferring nip N in synchronism with the toner image on the photosensitive drum 1. At the same time the tip end of the transferring material P enters the transferring nip N, the initial target transfer voltage Vt1 is applied in a constant voltage (step 3). A certain time after application of the initial target transfer voltage Vt1 starts, transfer current is monitored (step 4). The transfer voltage correction value is determined according to the transfer current monitored and Vt1 (step 5). The transfer voltage Vt, obtained by adding the correction value Vr to the value determined from the above equation, is applied to the transferring roller 5 is a constant voltage (step 6) to transfer an image at a constant voltage applied until the trailing end of the transferring material is reached.

$$Vt=\alpha Vt0+\beta+Vr \quad \text{(Equation 2)}$$

Figure 5C:
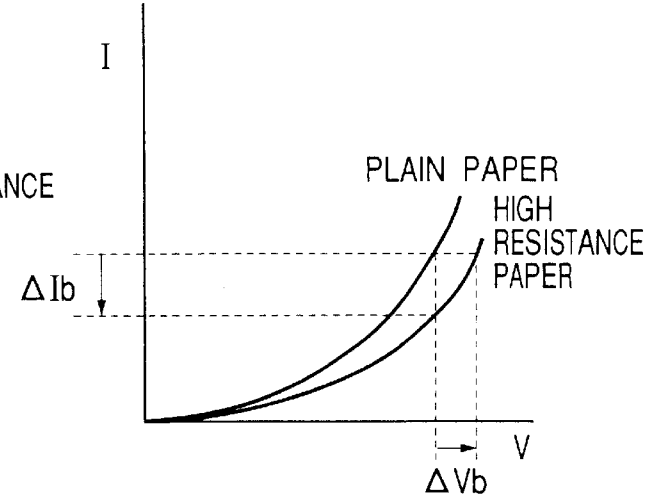
FIGS. 5A, 5B and 5C show changes in transfer voltage and transfer current with transferring material resistance in several environments.
Figure 5B:
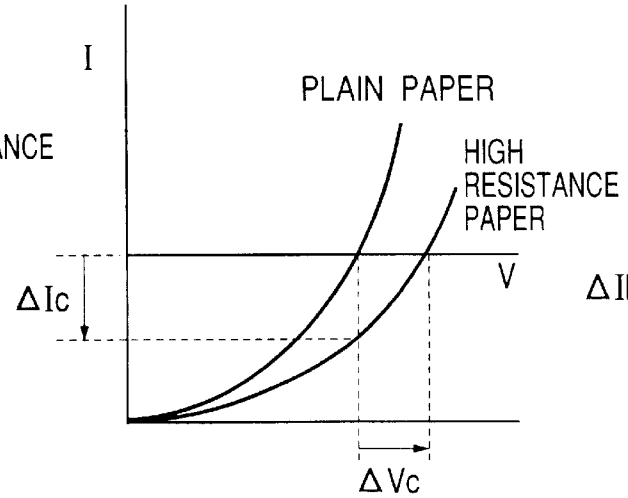
Figure 5A:
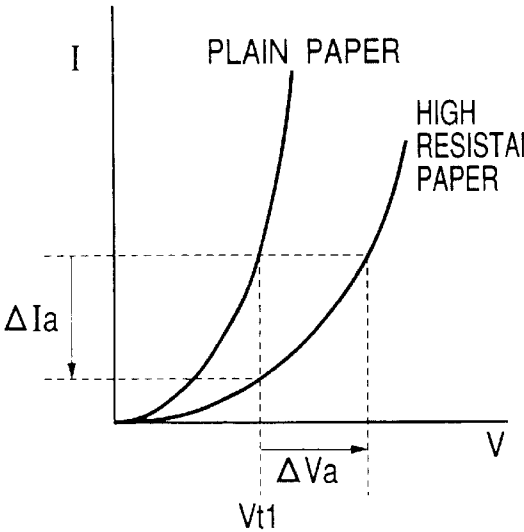

FIGS. 5A through 5C are graphs showing transfer current changes due to transferring material resistance in several environments in the system used for the embodiment. The current values in the graphs are as measured during printing on the other side which increases transferring material resistance, thus causing an exploded image to generate easily.

Transferring material resistance changes under the effect of humidity in each environment. However, transferring material resistance keeps almost constant irrespective of the environment during printing on the other side, which poses a problem of image explosion, because moisture of the transferring material P has evaporated due to its pass through the fixing apparatus 13 during printing on one side.

FIG. 5A shows the relationship between transfer voltage V and transfer current I in a high-temperature high-humidity environment H/H (30° C., 85%RH) where transferring roller resistance decreases; FIG. 5B, the V-I relationship in a normal environment N/N (23° C., 60%RH); and FIG. 5C, the V-I relationship in a low-temperature low-humidity environment L/L (15° C., 10%RH) where transferring roller resistance increases.

As shown in the drawings, the higher transferring material resistance, the smaller current running during transfer. To provide a satisfactory image, the current decrease must be made up for by increasing transfer voltage by ΔV.

In the embodiment, where the initial target transfer voltage Vt1 is set so that a desired current runs during printing on plain paper, transfer voltage decrease at the tip end of the transferring material, which occurs when high-resistance paper is printed, is detected to correct transfer voltage.

As shown in FIG. 5A, in a high-temperature high-humidity environment, where as transferring roller resistance decreases, the impedance of the entire transferring system decreases, system impedance change due to transferring material entry into the system is significantly large, compared with the impedance of the entire system before transferring material entry, so that transferring material resistance causes a large slope difference as shown by the V-I curve In FIG. 5A. To make up for the current decrease ΔI, a correction value ΔV to be added to initial transfer voltage must be increased.

On the contrary, in a low-temperature low-humidity environment, where as transferring roller resistance increases, the impedance of the entire transferring system increases, system impedance change due to transferring material entry into the system is small, compared with the impedance of the entire system before transferring material entry, so that a change in transferring material resistance does not causes a large V-I curve slope difference as shown by the V-I curve in FIG. 5C. Because of this, the correction value to be added to initial transfer voltage have only to be set small.

As described above, if transferring roller resistance is low, so that the impedance of the entire system is also small, both ΔIa and ΔVa are large because transferring material resistance largely affect them. In contrast, if transferring roller resistance is high, so that the impedance of the entire system is large, both ΔIb and ΔVb only slightly change because transferring material resistance does not largely affect them. Thus transfer voltage correction must be adjusted during printing on high-resistance paper according to the original resistance of the entire transferring system. Based on the result of PTVC detection, the embodiment optimizes transfer voltage correction for high-resistance paper. Incidentally, ΔIc in FIG. 5B is a current drop amount in the normal environment, and ΔVc is a voltage correction amount.

Figure 6:
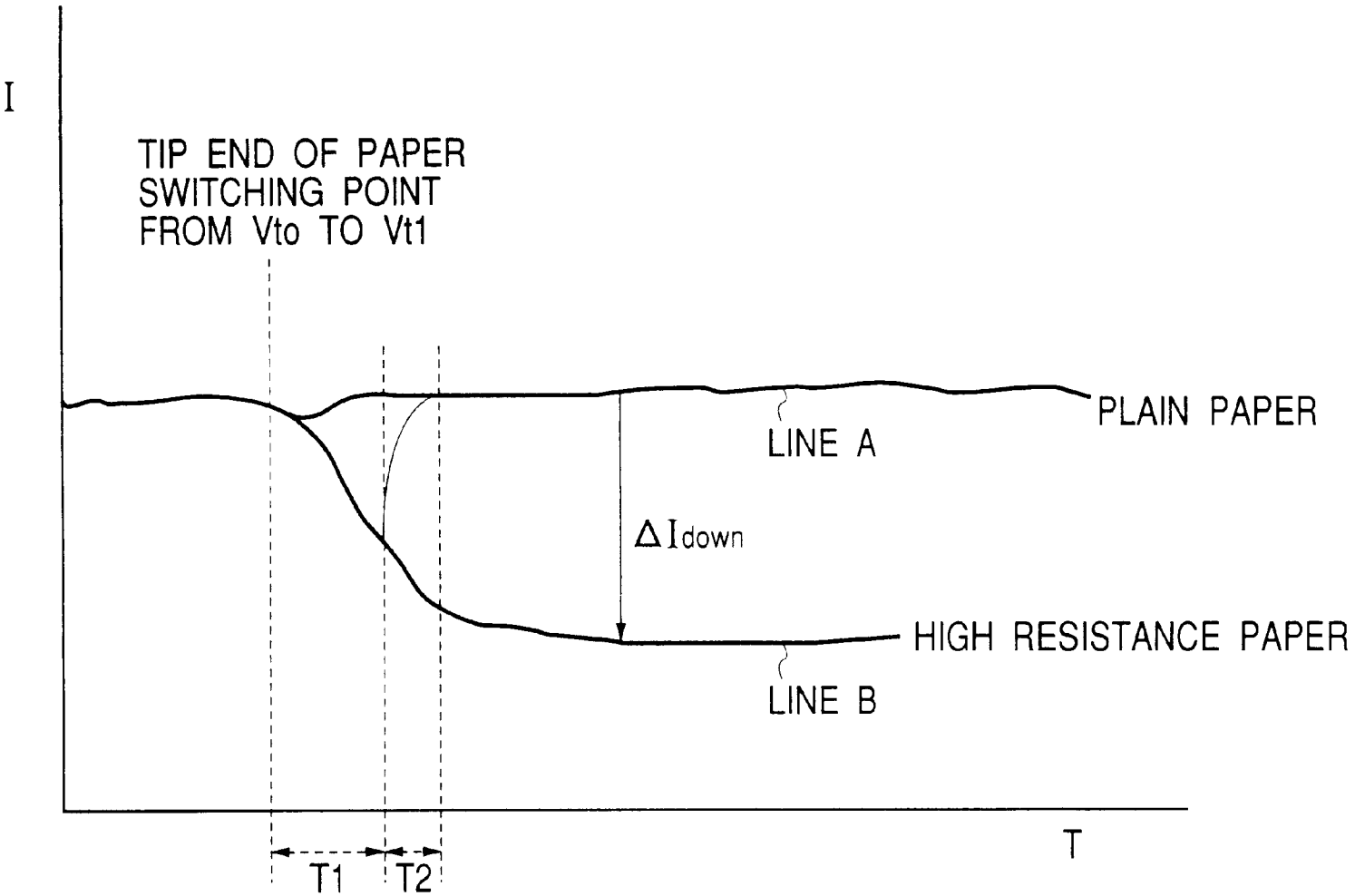
FIG. 6 shows changes in transfer current in a tip end of the transferring material with transferring material resistance.

FIG. 6 shows how transfer current I (AD value) changes at the tip end of transferring materials with different resistances when they are fed. The vertical axis I and horizontal axis T represent transfer current and elapsed time, respectively.

Because in the embodiment, the initial target transfer voltage Vt1 during paper feed, which is determined based on the result of PTVC detection, is set so that the best current runs when ordinary paper is fed, a transfer current (AD value) I which is almost the same as the target current is provided as indicated by a line A when plain paper is printed.

On the contrary, when high-resistance paper is printed, current running through the transferring roller decreases by ΔIdown according to high transferring material resistance as shown by a line B.

Thus, transfer current (the AD value) can be monitored a time T1 after the tip end of transferring material reaches the transferring nip N, that is, when difference in transfer current decrease due to transferring material resistance is noticeable to detect transferring material resistance.

In the embodiment, the AD value is monitored 40 ms after the tip end of the transferring material reaches the transferring nip N to detect transferring material resistance and determine whether the transferring material is plain paper or high-resistance paper. If the transferring material is considered to be high-resistance paper, a voltage Vt1', or Vt1 plus a voltage value Vr which makes up for the transfer voltage reduction ΔIdown, is applied to the transferring material. Voltage value switching causes transfer current to increase, so that the target transfer current is reached a time T2 after voltage switching. It is desirable that the time T1 at which transferring material resistance is detected be set outside a print quality assurance range, taking into account the time T2, which elapses by the time voltage responds after transferring material resistance detection. Whether transferring material resistance is high or low is determined by setting a threshold value for transfer current value (the AD value).

c) Experimental example and comparative example

Table 1 gives the relationship among transfer voltage, transfer current, and image quality as observed when plain paper which has a volume resistivity of $1\times10^{11}$ Ω·cm and high-resistance paper which has a volume resistivity of $1\times10^{13}$ Ω·cm are printed at a process speed of 120 mm/sec, using an image forming apparatus of the present invention for several transferring roller resistances.

Applied are a transfer voltage which is produced when PTVC detection is performed at a constant current of 6 μA and a transfer voltage which is calculated from the following control equation (Equation 2), stored in the CPU.

$$Vt1=0.7\times Vt0+700 \quad \text{(Equation 3)}$$

(All terms are expressed in volts.)

In an experiment example 1, different transfer voltage correction values are used for high-resistance paper, based on the result of PTVC detection.

In a comparative example 1, a constant transfer voltage correction value is used for the transferring material which is considered to be high-resistance paper.

Data is given on a comparative example 2 in which transferring material resistance was not detected.

In the comparative example 1, if the transferring material is considered to be high-resistance paper, a constant correction value is used to correct transfer voltage no matter whether the impedance of the transferring system is high or low. Thus transfer current is insufficient, resulting in image explosion if transferring roller resistance is low, while transfer current is excessive, resulting in a penetrated image if transferring roller resistance is high.

In the comparative example 2, when high-resistance paper is used, transfer current runs short at any transferring roller resistance, resulting in a poor transfer, because transfer voltage is not corrected at all by detecting transferring material resistance.

In the experiment example 1, to which the embodiment is applied, the transfer voltage correction value is set large if transferring roller resistance is considered to be low, and the correction value is set small if transferring roller resistance is considered to be high. In both cases, a good image was formed.

In the embodiment, printing is done at a process speed of 120 mm/sec, and the transfer voltage Vt increases to a desired value 10 ms after transferring material resistance is detected at a distance from the tip end of the transferring material, which distance corresponds to 40 ms of printing. Thus 50 ms after printing starts, that is, at a distance of about 6 mm from the tip end of the transferring material, transfer voltage completely increases to a necessary value. Printing, with a margin of about 5 mm provided, did not cause any image problems.

For the embodiment, transferring material is divided into two types according to resistance. However, transferring material may be subdivided as required.

As described above, an image forming apparatus which uses a PTVC method to correct transfer voltage, based on the result of transferring material resistance detection made at the tip end of transferring material allows a good image to be formed irrespective of transferring roller resistance and transferring material resistance by setting the transfer voltage correction value for high-resistance paper large if transferring roller resistance is low and setting the value small if transferring roller resistance is high.

TABLE 1

<Experiment example 1>

| | 30° C. 85% RH | | 23° C. 60% RH | | 15° C. 10% RH | |
|---|---|---|---|---|---|---|
| Transferring roller resistance | Plain paper | High-resistance paper | Plain paper | High-resistance paper | Plain paper | High-resistance paper |
| Vto [V] | 200 V | | 350 V | | 1000 V | |
| Vt1 [V] | 840 V | | 945 V | | 1400 V | |
| Vr [V] | 600 V | | 450 V | | 350 V | |
| Vt1 [V} | 840 V | 1440 V | 945 V | 1395 V | 1400 V | 1750 V |
| Transfer current [μA] | 6.5 μA | 6.2 μA | 6.1 μA | 5.8 μA | 5.9 μA | 5.7 μA |
| Image quality | good | good | good | good | good | good |

<Comparative example 1>

| | 5E + 07 [Ω] | | 8E + 07 [Ω] | | 1E + 08 [Ω] | |
|---|---|---|---|---|---|---|
| Transferring roller resistance | Plain paper | High-resistance paper | Plain paper | High-resistance paper | Plain paper | High-resistance paper |
| Vto [V] | 200 V | | 350 V | | 1000 V | |
| Vt1 [V] | 840 V | | 945 V | | 1400 V | |
| Vr [V] | 600 V | | 450 V | | 450 V | |
| Vt1 [V} | 840 V | 1290 V | 945 V | 1395 V | 1400 V | 1950 V |
| Transfer current [μA] | 6 μA | 4.5 μA | 6.1 μA | 5.8 μA | 5.9 μA | 7.5 μA |
| Image quality | good | Explosion fair | good | good | good | Penetration fail |

<Comparative example 2>

| | 5E + 07 [Ω] | | 8E + 07 [Ω] | | 1E + 08 [Ω] | |
|---|---|---|---|---|---|---|
| Transferring roller resistance | Plain paper | High-resistance paper | Plain paper | High-resistance paper | Plain paper | High-resistance paper |
| Vto [V] | 200 V | | 350 V | | 1000 V | |
| Vt1 [V] | 840 V | | 945 V | | 1400 V | |
| Transfer current [μA] | 6 μA | 2.8 μA | 6.1 μA | 3.5 μA | 5.9 μA | 45 μA |
| Image quality | good | Explosion poorer | good | Explosion fail | good | Explosion fair |

Figure 7A:
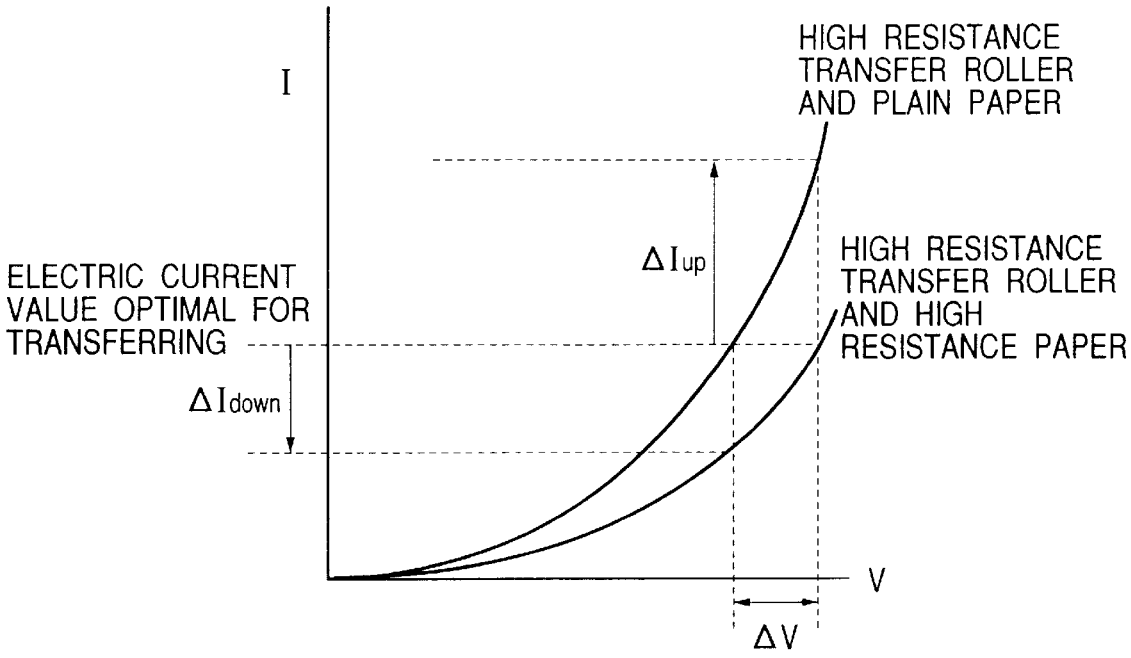
FIGS. 7A and 7B illustrate a second embodiment.
Figure 7B:
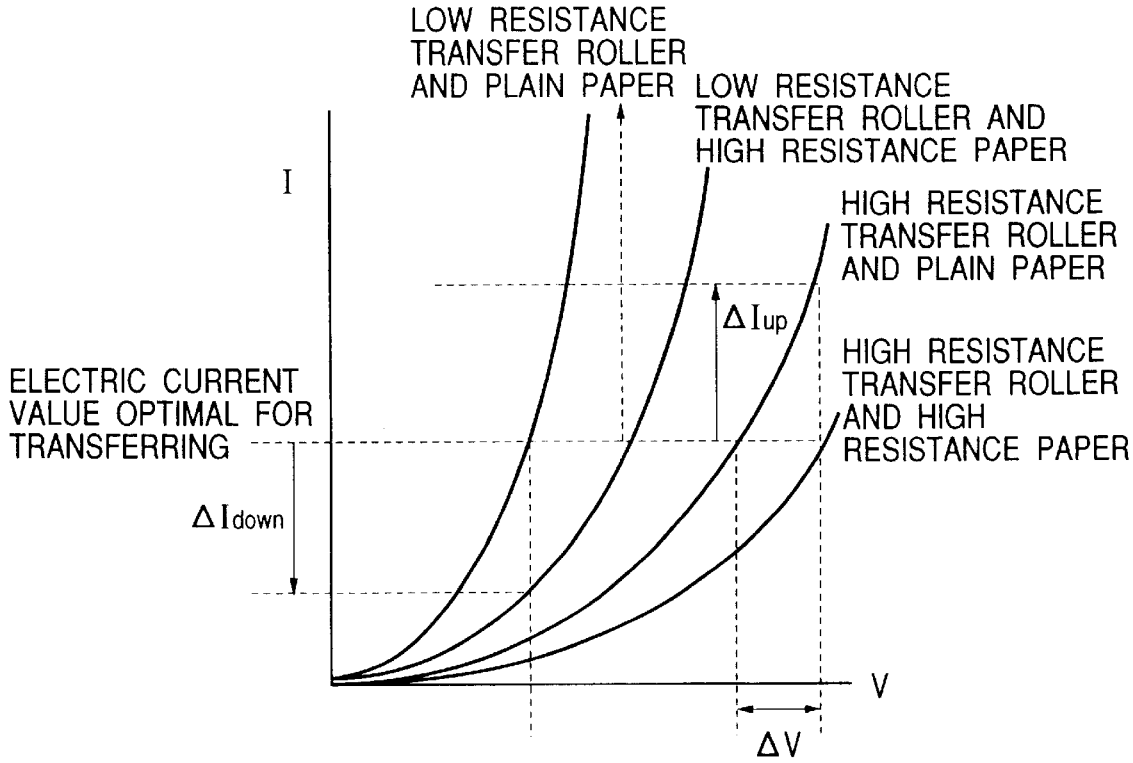

<Second Embodiment> (FIGS. 7A and 7B)

In art image forming apparatus of the second embodiment which monitors transfer current to correct transfer voltage when the tip end of transferring material enters the transferring nip N, initial target transfer voltage applied during transfer material resistance detection and transfer material resistance detection timing algorithm are varied, depending on the result of PTVC detection.

In the first embodiment, the voltage Vt1 to be applied during resistance detection at the tip end of transferring material is set so that the most suitable current for plain paper flows according to transferring roller resistance, and transfer current reduction at the tip end of high-resistance paper is detected to correct transfer current. On the other hand, in this embodiment, on the basis of the result of PTVC detection the initial target transfer voltage Vt1 is switched between values suitable for ordinary paper and high-resistance paper according to transferring roller resistance value and later current change at the tip end of transferring material is monitored to correct transfer voltage.

FIG. 7A shows transfer current difference ΔI between cases where the initial target transfer voltage Vt1 is set so that the most suitable current for ordinary paper and high-resistance paper flows.

As shown in the figure, setting Vt1 according to ordinary paper causes current to decrease by ΔIdown when high-resistance paper is used, while setting Vt1 according to high-resistance paper causes current to increase by ΔI up when plain paper is used. A comparison of both cases shows that the current increase is larger than the current decrease in the latter case.

However, as shown in FIG. 7B, if transferring roller resistance is low, the current increase as observed when plain paper is used is so large that an excessive current runs through the photosensitive drum 1, thus causing a horizontal black striped memory image to occur after the photosensitive drum 1 makes one turn.

In the embodiment, to solve this problem, transferring material resistance detection algorithm is switched between current increase monitoring and current decrease monitoring methods according to the result of transferring roller resistance detection to select the better of these two methods.

Like this, because a transfer voltage suitable for high-resistance transferring material is applied from the tip end of the material, changing transferring material resistance detection algorithm according to the result of PTVC detection as described above causes explosion not to easily occur at the tip end of transferring material in a low-temperature low-humidity environment where the explosion easily occurs because of increased transferring roller resistance and transferring material resistance. In addition, detecting current increase on the plain paper causes transferring material resistance detection accuracy to increase.

In contrast, because a transfer voltage suitable for plain paper is applied at the tip end of transferring material, a poor memory image due to concentrated current flow through the tip end of transferring material can be prevented in a high-temperature high-humidity environment where explosion does not easily occur because of reduced transferring roller resistance and transferring material resistance. Moreover, because transfer current variation with transferring material resistance is larger than in other environments, the paper type is not likely to be incorrectly detected, and a good image is formed in any environment.

<Others>

1) Forming a toner image on an image bearing body is not limited to an electrophotography process which uses an electrophotography photosensitive body as an image bearing body, but imaging methods which form a toner image on an image bearing body and make the body bear the image, such as an electrostatic recording process using an electrostatic recording dielectric as an image bearing body and a magnetic recording process using a magnetic recording body as an image bearing body, may be used.

2) The contact transferring member is not limited to a roller but may be a rotating belt.

3) In the present invention, transferring material includes intermediate transferring material, such as an intermediate transferring belt and an intermediate transferring drum.

The embodiments of the present invention have been described above. The present invention is not limited to the embodiments, yet various modifications are possible within the scope of the present invention.

What is claimed is:

1. An image forming apparatus comprising:

an image bearing body for bearing a toner image;

a transferring member for forming a nip with said image bearing body to pinch a transferring material and for transferring the toner image on said image bearing body to the transferring material;

voltage applying means for applying a transfer voltage to said transferring member;

voltage detecting means for detecting an applied voltage at which a predetermined current flows through said transferring member before a transferring operation;

current detecting means for detecting a current flowing when a voltage based on a detected voltage of said voltage detecting means is applied to said transferring member in a condition where a tip end of the transferring material is present at the nip; and voltage determining means for determining the transfer voltage after the tip end of the transferring material, based on a detected current of said current detecting means.

2. An image forming apparatus according to claim 1, wherein said voltage detecting means detects the applied voltage while the voltage applied to said transferring member is stepwise varied.

3. An image forming apparatus according to claim 1, wherein said voltage determining means corrects the detected voltage of said voltage detecting means, based on the detected current, to determine the transfer voltage.

4. An image forming apparatus according to claim 3, wherein said voltage determining means determines the transfer voltage in which a correction value is added to the detected voltage when the detected current is small.

5. An image forming apparatus according to claim 1, wherein the tip end of transferring material at which said current detecting means detects the current is a margin portion.

6. An image forming apparatus according to claim 1, wherein said transferring member has a rubber layer.

* * * * *

UNITED STATES PATENT AND TRADEMARK OFFICE

CERTIFICATE OF CORRECTION

PATENT NO. : 6,404,998 B1 
DATED : June 11, 2002
INVENTOR(S) : Yuko Tanaka et al.

It is certified that error appears in the above-identified patent and that said Letters Patent is hereby corrected as shown below:

Column 1,
Line 29, "conveyance" should read -- conveyance, --.

Column 3,
Line 57, "environments." should read -- environments; --.

Signed and Sealed this

Third Day of September, 2002

*Attest:*

*Attesting Officer*

JAMES E. ROGAN
*Director of the United States Patent and Trademark Office*